United States Patent [19]

Morgan

[11] 4,407,123

[45] Oct. 4, 1983

[54] HOT GAS STIRLING CYCLE PISTON ENGINE

[76] Inventor: George R. Morgan, 1831 S. Berthed Pl., Tucson, Ariz. 85710

[21] Appl. No.: 198,586

[22] Filed: Oct. 20, 1980

[51] Int. Cl.[3] ..... F02G 1/04

[52] U.S. Cl. ..... 60/525; 60/517

[58] Field of Search ..... 60/516, 517, 525, 526; 92/67–69, 120, 165

[56] References Cited

U.S. PATENT DOCUMENTS

| | | | |
|---|---|---|---|
| 2,387,467 | 10/1945 | Reiter | 92/67 X |
| 2,651,206 | 9/1953 | La Veille | 92/67 X |
| 3,527,049 | 9/1970 | Bush | 60/524 X |
| 3,845,624 | 11/1974 | Roos | 60/517 |
| 4,255,929 | 3/1981 | McDougal | 60/517 |

*Primary Examiner*—Allen M. Ostrager

[57] ABSTRACT

A hot gas toroidal, oscillating, close coupled Stirling cycle piston engine, whereby a gas is heated in an external combustion system and expanded in a hot cylinder. Thus, the expanding gas moves the piston to its bottom or extended position in the cylinder, exposing ports which exhaust the gas through a regenerator-cooler and into a cold cylinder. The cooled gas is then compressed in the cold cylinder and forced back through said regenerator-cooler into the hot cylinder to be reheated and expanded.

1 Claim, 7 Drawing Figures

HOT GAS STIRLING CYCLE PISTON ENGINE

The object of this invention is to provide a close coupled, compact, efficient, versatile and viable external combustion Stirling cycle piston engine.

The close coupling of said engine is achieved by eliminating the connecting rod between piston and crankshaft. This is done by utilizing a single throw crankshaft that connects to a slider block which slides in a slot in the piston, converting oscillatory motion to rotary motion.

The toroidal design of said engine makes a compact unit as each piston is double ended, making a work space in the cylinder as each pair of pistons oscillates around a common point or axis; each said piston has a single throw crankshaft that is geared to the output shaft. The regenerator-cooler units that connect the hot cylinder to the cold cylinder are short and direct. Each group of heating pipes is attached externally and directly above the hot cylinders, making a compact unit for the combustion system.

Said engine's basic design lends itself to very high temperatures, and, therefore, high efficiency. This is accomplished by incorporating thick cylinder walls, heavy gear housing sections, and a simple rugged mechanism.

Another object of said engine is to provide a versatile and viable product by utilizing the method of adding or subtracting gas into the cold cylinder to vary the load or revolutions. The rectangular piston area can be varied as well as the stroke. The cold piston phase angle can vary for a particular load or RPM. A versatility of materials can be used depending on the performance desired. For different efficiencies said engine can be fabricated from a broad range of materials, such as cast iron to ceramics. Lubrication also will vary from the usual oil to solid graphite or the like. The number of pistons can be increased from four, six, or eight, or whatever the performance might demand. Piston length can be varied by increasing/decreasing the diameter of said engine. Output shaft rotation versus crankshaft rotation can be varied by gear diameters. Any type of external burning unit can be attached to said engine. Piston seals can be fabricated from a broad range of materials to suit the type of engine desired. Size of said engine is also variable.

DETAILED DESCRIPTION

Figure 1:
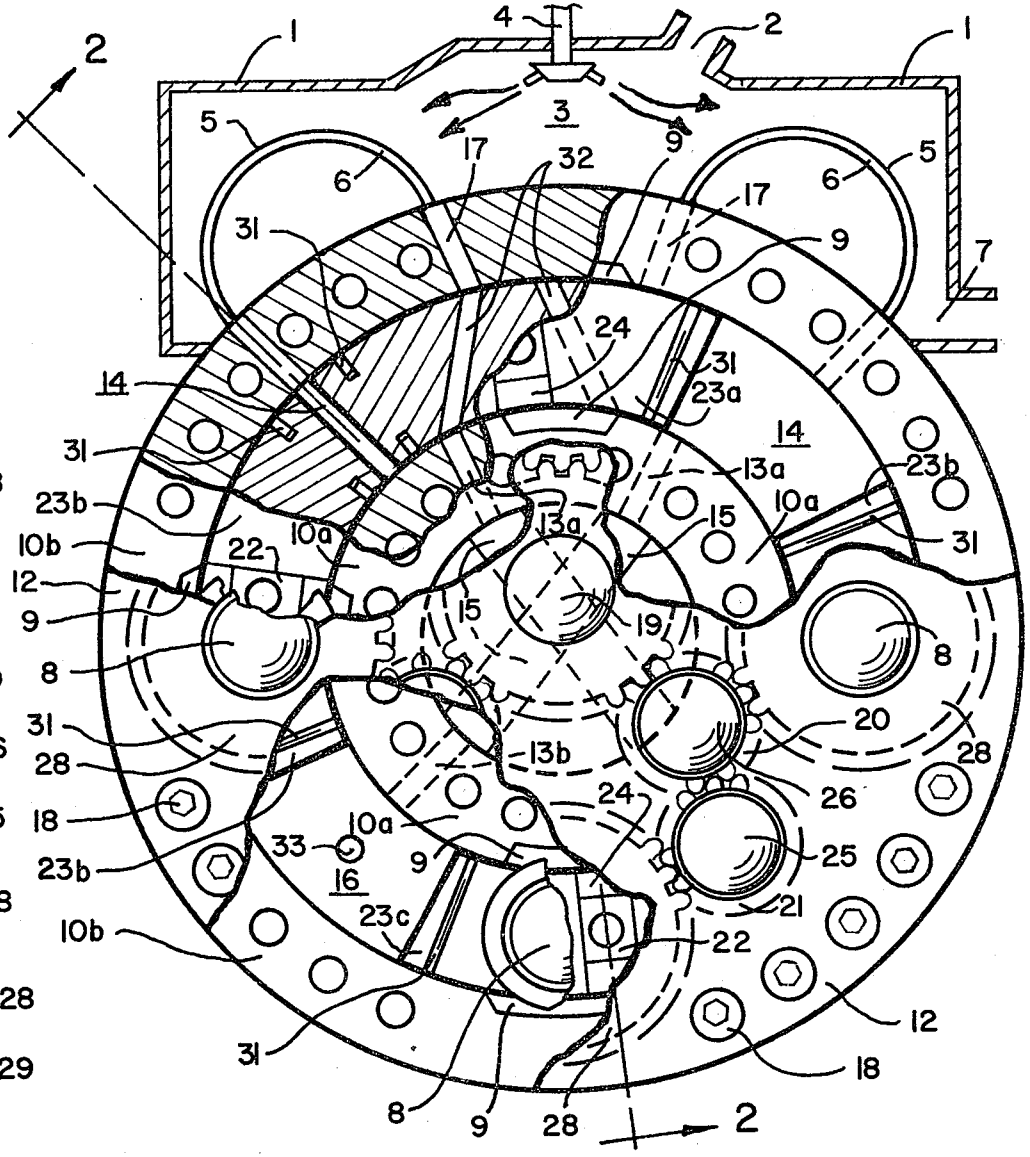
FIG. 1 is an end elevation view of the engine with a gear and areas of the gear housing removed to show the working mechanism, porting and burner configuration.
Figure 2:
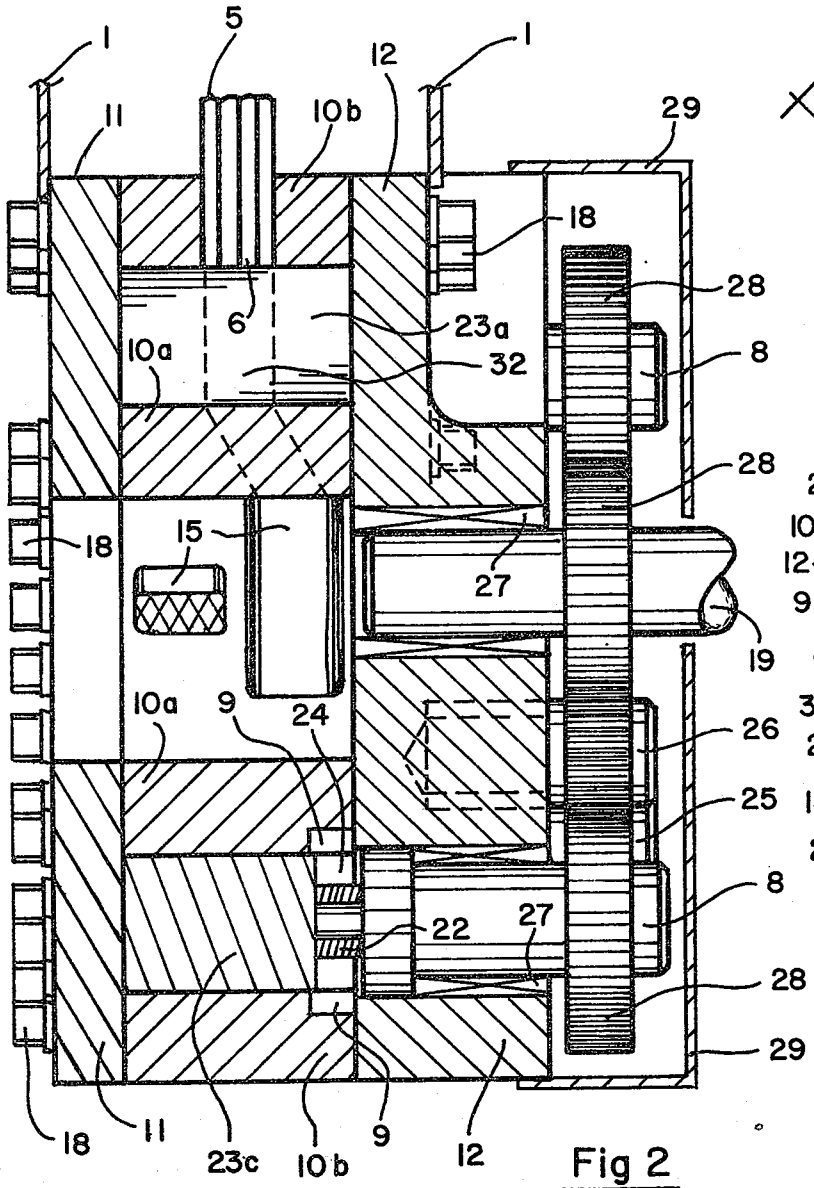
FIG. 2 is a longitudinal sectional view taken along the line 2-2 of FIG. 1.
Figure 6:
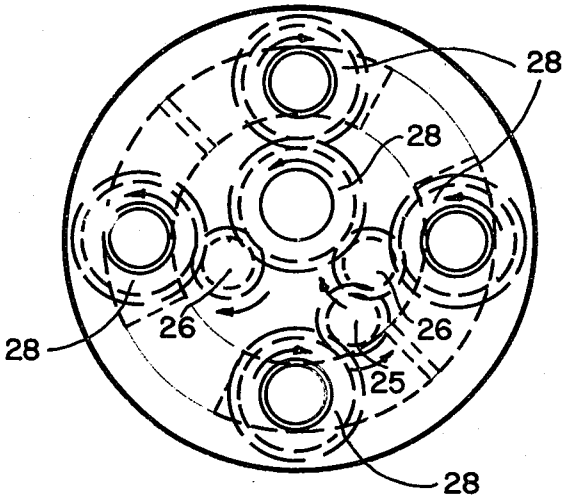
FIG. 6 is a diagrammatic view showing the crankshaft gears, output gear, and idler gears and their direction of rotation.
Figure 3:
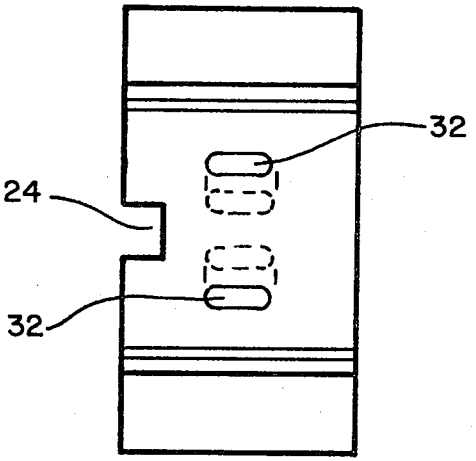
FIG. 3 is a longitudinal view of the hot piston in FIG. 1.
Figure 5:
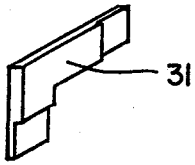
FIG. 5 is an isometric sketch of one of the piston seals.
Figure 4:
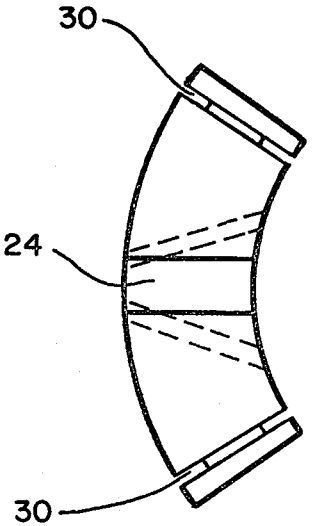
FIG. 4 is an elevation view of the hot piston in FIG. 3.
Figure 7:
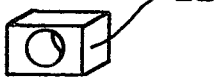
FIG. 7 is an isometric sketch of the slider block.

The engine is a short cylindrical type configuration whereby the rectangular cylinder is toroidal and continuous, except where the crankshafts 8 extend into the cylinder area 9 about a point or axis. Said engine is constructed of three major components: a cylinder housing 10, back plate 11, and gear housing 12. Said cylinder housing 10 consists of two annular sleeves (see FIG. 1 & 2), an inner sleeve 10*a* with ports 13 that communicate from the hot working space 14 via the regenerator-cooler 15 to the cold working space 16 and an outer sleeve 10*b* with ports 17 that communicate to the heater tubes 5 and the hot working space 14. FIG. 2 shows that the back plate 11 is flat with an opening in the center to facilitate said regenerator-cooler 15 units and is bolted 18 to said cylinder housing 10, locating said inner sleeve 10*a* concentrically and making up one side of the rectangular cylinder 9. FIG. 2 shows how said gear housing 12 attaches to the other side of said cylinder housing 10, making the rectangular cylinder complete. The said gear housing 12 consists of an output shaft 19, two idler gears 20, a timing gear 21, and four single throw crankshafts 8, whereby the offset crankpin inserts in the hole of the slider block 22, which together slides in said piston slot 24. Said output shaft 19, crankshafts 8, timing gear shaft 25, idler gear shaft 26 are mounted in bearings 27 and have gears 28 attached to one end, whereby the said gears 25, 26, 28 are in mesh and timed and protected by the gear cover 29. In FIG. 1 the gear cover 29 is removed for clarity. As the four pistons 23 move in an oscillatory motion, the crankshafts 8 rotate transmitting power to the output shaft 19. FIGS. 3, 4, 5, 7 denote that said hot piston 23*a* is rectangular and curved to fit the toroidal cylinder shape and is double ended with rectangular grooves 30 in each end whereby said seals 31 fit, making it possible to work in conjunction with adjacent said piston 23. The piston slot 24, whereby the slider block 22 slides, is on the top edge of said piston 23. The said regenerator-cooler 15 communicates with said heater tubes 5, through the said inner sleeve port 13*a*, hot piston port 32, and outer sleeve port 17. The hot piston ports 32 are located in the curved portion of hot piston 23*a*. The other three pistons 23 are of the same configuration except there are no through ports 32. FIG. 6 shows how said gears 28 and related pistons 23 movements cancel out the inertia forces, whereby vibration is a minimum. An external heating system is shown diagrammatically in FIG. 1, with which this invention is concerned. It comprises an external housing 1 which contains an air intake 2 that receives preheated air into the combustion chamber 3, where a burner 4 ignites the air in which the combusted gases pass through and circulate about the heater tube 5, transferring heat to the internal working gas 6, which is then exhausted through channel 7 and into a preheater system.

In the operation of said engine (see FIGS. 1 & 2), the hot piston 23*a* is in the extended or bottom position in the hot working space 14, denoting a heated gas has been expanded, exposing the cylinder port 13*a* (shown dotted). The hot expanded gas 6 exhausts through the exposed cylinder port 13*a* and into the regenerator-cooler 15, which communicates to the cold working space 16 via the cold cylinder port 13*b*. By an external means (not shown) gas is added/subtracted from the cold working space 16 via the cold cylinder port 33 to vary the load or RPM of said engine. The cold piston 23*c* (which has a leading phase angle relative to the said hot piston 23*a* ) and piston 23*b* move and compress the now cooled said expanded hot gas 6 in said cold working space 16 back through said regenerator-cooler 15 via the said cold cylinder port 13*b*, reheating the cooled said expanded hot gas 6. At the same time said hot piston 23*a* moves and compresses the residual said expanded hot gas 6 in the hot working space 14, lining up port 32 in said hot piston 23*a*, whereby reheated cooled expanded hot gas 6 is forced into heater tubes 5 via cylinder port 32 to be reheated and recycled again. The same cycle of events is repeated in said hot working space 14 by piston 23*b* and said hot piston 23*a* except 180° out of phase.

What is claimed is:

1. A hot gas Stirling cycle engine in which a plurality of gases are alternately expanded and compressed in closed thermodynamic systems comprising:

a toroidal cylinder with four double-ended pistons which oscillate around the central axis in a fixed phase relationship;

a transmission means operatively coupling each piston with a respective rotatable crankshaft, each of the crankshafts being mounted perpendicular to the central axis of the toroidal cylinder;

an output shaft located in the proximity of and parallel to the cylinder axis, and operatively coupled to each of said rotatable crankshafts;

said pistons and their respective crankshafts being radially disposed and equally spaced within said cylinder;

a first working space defined by a first piston and an adjacent second piston in which heated gas expands to perform work in moving said pistons;

a second working space defined by the second piston and an adjacent third piston in which a cooled gas is compressed;

a third working space defined by the third piston and an adjacent fourth piston in which a cooled gas in compressed;

a fourth working space defined by the fourth and first piston in which a heated gas expands to perform work in moving said pistons;

a first heating means external of said cylinder providing a heat source for gas flowing into said first working space, a second heating means external of said cylinder providing a heat source for gas flowing into said fourth working space;

a first regenerator-cooler unit located near the axis of the toroidal cylinder and located in a gas passage connecting the first and third working spaces;

a second regenerator-cooler unit located near the axis of the toroidal cylinder and located in a gas passage connecting the second and fourth working spaces;

whereby a first working gas is heated by said first heating means, flows into said first working space where it expands to perform work, flows through the first regenerator-cooler to said third working space where it is compressed, and thereafter flows through said first regenerator-coder and thence to said heater to cyclically perform a first Stirling cycle, wherein a second working gas is heated by said second heating means, flows into said fourth working space where it expands to perform work, flows through the second regenerator-cooler to said second working space where it is compressed, and thereafter flows through the second regenerator-cooler and thence to said heater to cyclincally perform a second Stirling cycle;

wherein said first and second cycles are 180° out of phase with one another.

* * * * *